United States Patent [19]

Perret

[11] Patent Number: 4,560,028

[45] Date of Patent: Dec. 24, 1985

[54] SOUND ABSORBING WALL LINING

[75] Inventor: René Perret, Grenoble, France

[73] Assignee: Alsthom-Atlantique, Paris, France

[21] Appl. No.: 720,935

[22] Filed: Apr. 8, 1985

[30] Foreign Application Priority Data

Apr. 9, 1984 [FR] France ..... 84 05558

[51] Int. Cl.[4] ..... E04B 1/82

[52] U.S. Cl. ..... 181/288; 181/291; 181/292; 181/294; 181/286

[58] Field of Search ..... 181/175, 284, 286, 288, 181/290–292, 294

[56] References Cited

U.S. PATENT DOCUMENTS 3,136,380 6/1964 McCoy et al. ..... 181/292 X 3,961,305 6/1976 Green ..... 367/171

4,421,455 12/1983 Tomren ..... 415/119

*Primary Examiner*—Benjamin R. Fuller

*Attorney, Agent, or Firm*—Sughrue, Mion, Zinn, Macpeak & Seas

[57] ABSTRACT

In sound absorbing lining, conduits (4) are provided, filled with a viscous damping fluid, and are in contact by their ends facing towards the rigid supporting wall (1) to which the lining is applied with flexible cells containing a gas and forming a readily compressible material, for example foam rubber (6). Said conduits are separated from the ambient medium (2) by a separating membrane (3) which is permeable to acoustic waves. Lining is applied to absorbing acoustic waves underwater.

11 Claims, 7 Drawing Figures

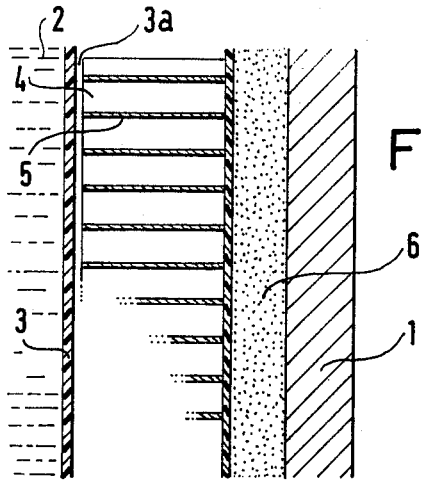
FIG.1
FIG.2
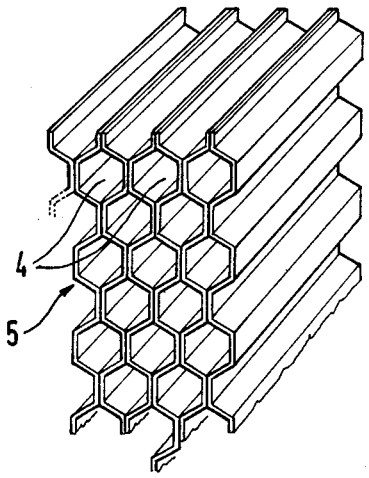
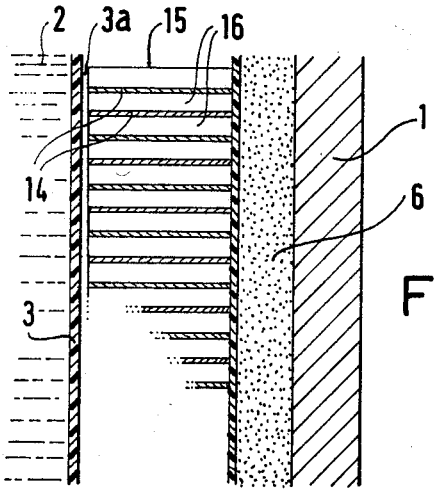
FIG.3
FIG.4
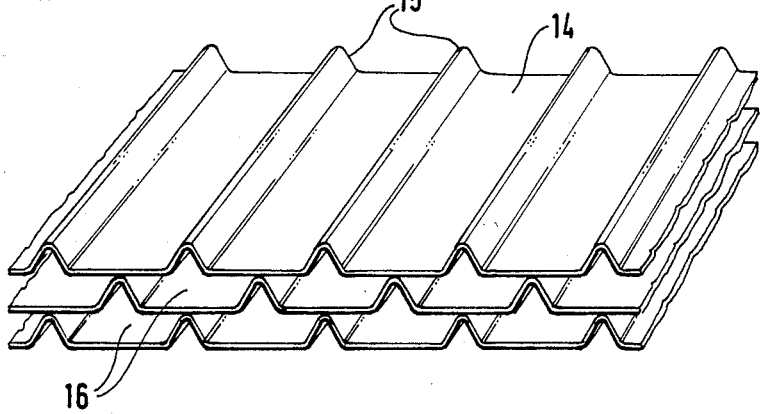

SOUND ABSORBING WALL LINING

This invention concerns a sound absorbing wall lining. When a noise source and a rigid-walled body are placed in a fluid medium where sound waves can propagate, part of the energy carried by the waves striking the wall is reflected, part of it is transmitted through the wall, and a small part is absorbed by the material making up the wall or its lining.

The ratio of the absorbed energy to the incident energy, or absorption coefficient, is a function of the nature of the wall or wall lining material and of the sound frequency involved.

There are several known types of system for boosting the absorption coefficient of walls with respect to airborne sounds, including:

Porous materials in the voids thereof wherein the acoustic energy is converted to heat by turbulence and friction so that, when the sound wave reaches the stiff, solid part of the wall, it has lost its energy and is only very weakly reflected;

Resilient panels forming a spring-mass system which, when their vibration period matches that of the acoustic wave, cause part of the incident energy to be transformed into mechanical energy, then dissipated through internal friction and deformations;

and resonator cell systems, which also behave as spring-mass systems whose mass and resiliency are those of the air. In this type of system, which may be deemed to include the absorbant lining described in U.S. Pat. No. 4,421,455 (Tomren), part of the acoustic energy is dissipated in resonating, as the acoustic pressure drops in the resonator throat.

The drawback of all these systems is that they are effective only over a limited frequency range.

The first type is effective only for high frequencies.

The latter two types are effective only in a very narrow range of frequencies centered on their own natural frequency.

The same problem of boosting the absorption coefficient of walls may arise with respect to waterborne sounds, for any of the following reaons:

to reduce the energy reflected by a submerged wall element placed between noise sources and acoustic receivers, such a wall being associated for example with an offshore, dynamically positioned oil drilling or production rig;

or to simulate wave propagations in an infinite medium in noise laboratories.

The ideal lining would:

cancel all, including partial reflections, of incident waves;

and operate over a broad band of frequencies including, where water is concerned, low frequencies between 10 and 1000 Hertz.

The known linings have proved very inadequate when the propagating medium is a liquid, especially for low frequencies below 1000 Hz.

It is the object of the present invention to provide efficient sound absorption, even in a liquid environment and for low frequencies.

The lining according to the invention consists of an inside surface designed to be applied to a rigid supporting wall and an outside surface designed to be steeped in a fluid environment traversed by acoustic waves.

Said lining, like that proposed by the Tomren patent, comprises additional walls extending perpendicularly from the supporting wall and forming therebetween a number of energy dissipating conduits in which a dissipating or attenuating fluid can move in a slight reciprocating motion normal to the supporting wall with a certain amount of friction, said conduits being substantially straight, with constant cross sections, and with openings at said outside surface and said inside surface. Said lining further comprises a separating layer covering the openings of said conduits, which is permeable to acoustic waves.

In the known lining, both the ambient fluid and the dissipating fluid are air.

The lining according to the invention is characterized in that said energy dissipating conduits are filled with a dissipating fluid having a higher kinematic viscosity than the ambient fluid so that it may absorb, by laminar friction, the energy of said reciprocating motions, said separating layer being a membrane closing off the openings of the conduits to prevent the dissipating fluid from becoming diluted in the ambient fluid, said membrane being permeable to acoustic waves, and resilient, closed volumes being placed at the back of said conduits, in contact with the dissipating fluid, said volumes containing a fluid more readily compressible than the ambient and the dissipating fluids such as to amplify said reciprocating motions of the latter fluid in response to incident acoustic waves.

Preferably, the equivalent hydraulic diameter d and length l of the energy dissipating conduits, the perforation rate S2/S1 of the lining at the level of said conduits and the density $\rho_1$ of the dissipating fluid are such as to substantially satisfy the equation $$32(\rho_1 \cdot \nu_1 \cdot / d^2)1 = \rho_o \cdot C_o(S2/S1)$$

where $\rho_o$ and $C_o$ stand respectively for the density of the ambient fluid and the velocity of acoustic waves in said fluid, such that there exists a tuning frequency ($f_o$) for which matched frequency acoustic waves are virtually completely absorbed.

Specifically, the above equation means that an acoustic wave will theoretically be perfectly absorbed if the equation proves exactly, if the wave has a precise frequency value and if the thickness of the additional walls and the separating membrane have no influence on wave propagation. The term "substantially" is used deliberately to qualify the above proof to mean that the ratio of the two terms of the equation must be as close to 1 as possible and, practically speaking, should fall approximately somewhere between 0.2 and 5.

The perforation rate is the ratio of the open area S2 of a large number of adjacent conduits to the overall area of the lining S1 occupied by these conduits and the additional walls which bound them. It should be understood that these various quantities keep the same significance even when adjacent conduits are not entirely separated from one another by said additional walls; the crucial point for the invention is that certain zones exist—the conduits—in which the dissipating fluid can actually move under the influence of acoustic waves, and certain solid elements exist which, through friction, actually cancel the velocity of said fluid's motion in their immediate vicinity.

The equivalent hydraulic diameter d is equal to the diameter of the conduits if these have a circular cross section. It can be defined as equal to four times the ratio of their cross-sectional area to the wetted perimeter if their cross section is otherwise regularly shaped.

If the conduits have irregular shapes, the above-mentioned wetted perimeter is the length, in each cross section, of the boundary line between the zone where the fluid is stationary and the zone where fluid motion is possible. Actual fluid motion is slowed to various extents by the fluid's internal friction as a function of the fluid's distance from the nearest boundary line.

In water, the frequences of the sound waves to be absorbed extend over a broad spectrum, often down to less than about 1000 Hz, and the following relative values are preferably specified:

The kinematic viscosity $v_1$ should be great enough and the equivalent hydraulic diameter d should be small enough so that the ratio $v_1/d^2$ will be more than 2,500 rd/s, such that the range of frequencies effectively absorbed will be broadly extended on each side of said tuning frequency $f_o$.

When it is required to absorb acoustic waves having a frequency close to a frequency $f_o$, the kinematic viscosity $v_1$ of the dissipating fluid is greater than, or at least only slightly less than the product $f_o \cdot d^2$ of said frequency multiplied by the square of the equivalent diameter d, so that the distribution of reciprocation speeds in the flow section of the dissipating conduit will be comparable to that obtaining in a continuous, one-way laminar flow. Said viscosity should preferably be greater than half said product.

The stiffness K with which said resilient compression volumes confront the dissipating fluid is selected to be substantially $$K = 50 f_o^2 \cdot S2 \cdot \rho_1 \cdot 1$$

such that said tuning frequency be frequency $f_o$, the stiffness K being the relation of a force to a motion, said force being a longitudinal one able to be applied to the back of a conduit by an acoustic wave, said motion being the longitudinal one caused by said force and equal to the change in total volume of said compression volumes due to the action of said force, said change being divided by the cross section of the conduit.

The separating membrane can be very thin and very flexible so as not to be an obstacle to the passage of acoustic waves. However, such a thin membrane is extremely frail and can only be used for laboratory purposes. Besides, the present invention seems especially worthwhile at sea, at sometimes great depths. Accordingly, the separating membrane will preferably be made of a material with a value of the product $\rho_2 \cdot C_2$ equal to the product of $\rho_o \cdot C_o$ of the ambient fluid, said product being that of the material's density times the material's sound velocity, to ensure sufficient thickness for the membrane for it to withstand external aggressions and hydrostatic pressure differentials.

When the ambient fluid is a liquid, the dissipating fluid is an auxiliary liquid and the more readily compressible fluid is a gas enclosed in flexible cells, the overall enclosed volume of said flexible cell or cells at the back of each dissipating conduit being selected to yield approximately said K-value of stiffness.

Said gas is enclosed in said flexible cells at a swelling pressure greater than atmospheric pressure to prevent undue volume shrinkage of said cells when the surrounding hydraulic pressure increases.

Specifically, said swelling pressure should often be greater than two bars, absolute.

As for the dissipating fluid, it is made up of water with long-chain organic molecules added to enhance its viscosity.

A non-limiting example of construction of the lining according to the invention will now be described, with reference to the accompanying schematic drawings in which like items shown in different figures bear like references and in which:

FIG. 1 is a schematic cross section, taken along a plane perpendicular to the supporting wall, of a first embodiment of the lining according to the invention;

FIG. 2 shows an enlarged view in perspective of the additional walls of said lining;

FIG. 3 is a schematic cross section, taken along a plane perpendicular to the supporting wall, of a second embodiment;

FIG. 4 shows an enlarged view, in perspective, of the additional walls of the second embodiment;

Figure 7:
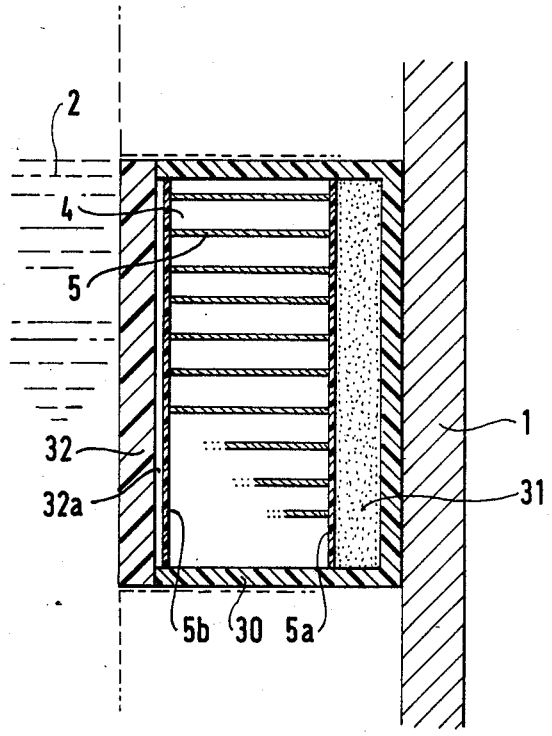

and FIG. 7 is another cross section taken along a plane perpendicular to the supporting wall, of a fourth embodiment of the lining according to the invention.

All of the drawings illustrate embodiments of the invention designed to absorb waterborne low-frequency sounds.

As shown in FIG. 1, the lining according to the invention is placed against a rigid supporting wall 1 immersed in an ambient fluid consisting of water 2, said lining comprising, from the outside to the supporting wall: a separating membrane 3 serving as a flexible interface between the ambient water 2 and an auxiliary liquid, a gap 3*a* and a metal honycomb 5 forming the dissipating conduits 4. Said conduits are on the order of 30 mm long, have a hexagonal cross-sectional area of approximately 1 $cm^2$ and are filled with a viscous liquid consisting for example of water mixed with a cellulose-based additive bringing up the viscosity of the auxiliary fluid to about $10^{-1}$ $m^2/s$, from $10^{-6}$ $m^2/s$ for plain water. A foam rubber pad 6 approximately 5 mm thick is provided at the back of the lining to serve as a resilient medium. The foam rubber's air- or gas-filled cells form said flexible cells containing said more readily compressible fluid. For laboratory applications, membrane 3 can be very thin. For undersea applications, the thin membrane is replaced by a thick membrane made of a material the product $\rho_2 \cdot C_2$ (density times sound velocity) of which is the same or very nearly the same as the corresponding product of $\rho_o \cdot C_o$ corresponding to the ambient water.

In another embodiment, the honeycomb depicted in FIG. 2 is replaced by corrugated paper, which is coated with resin and glued to form damping conduits.

Referring to FIGS. 3 and 4, the conduits containing the viscous fluid have a basically rectangular section and are formed by stacking fluted plates 14. The flutes or ribs 15 on these plates are approximately 1 mm high and together bound conduits 16 having a lengthwise dimension perpendicular to the wall of approximately 30 mm. Between said stacked plates and the rigid membrane is the resilient medium 6, for example foam rubber. On the water-side the plates are covered by the separating wall 3.

Figure 5:
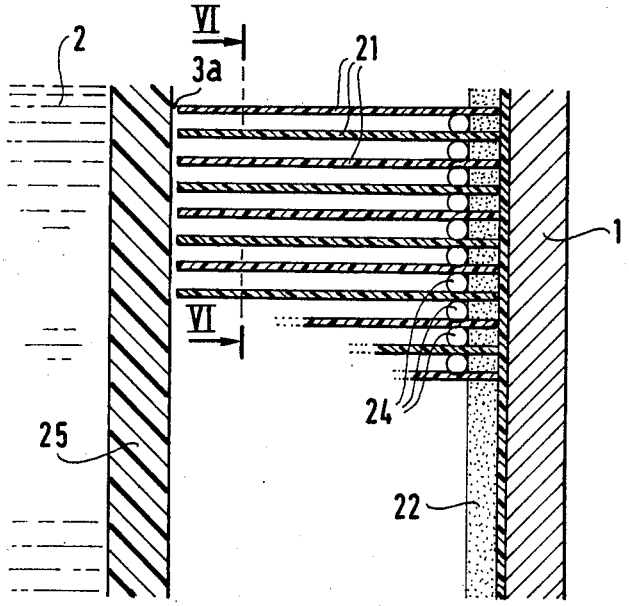
FIG. 5 is again a cross section taken along a plane perpendicular to the supporting wall of a third embodiment.
Figure 6:
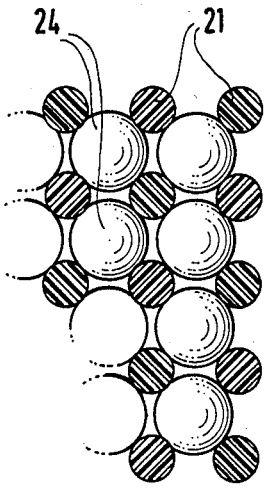
FIG. 6 is an enlarged view of the additional walls of the lining of FIG. 5, taken in cross section along VI—VI of that figure, in a plane parallel to the plane of the supporting wall.

In the embodiment represented in FIGS. 5 and 6 the energy losses affecting the acoustic waves result from the friction between the viscous liquid and a multitude of bristles 21 arranged like a brush and forming said additional walls. Each of these bristles is approximately 1 mm in diameter; they are spaced between 1 mm and 2 mm apart to form said conduits, which are thus in cross-communication. The bristles are set in a supporting plate 22 which is itself laid against the supporting wall 1. The separating membrane 25 is thick-walled. The compression volumes are made by placing small, hollow plastic balls 24 between the bristle roots, against the supporting plate 22. It would also be possible to use hollow bristles filled with air or gas.

The bristles are approximately 5 cm long. The $\rho_2 \cdot C_2$ product of the separating membrane 25 is the same as that of water.

Finally, the resilient compression volumes for all of the foregoing embodiments can be made using closed-cell foamed plastics in the manufacture of which it is possible to fill the cells with gas under a few bars' pressure. This alternative is especially attractive for walls subjected to variable hydraulic pressures from the ambient medium: the compression of the gas can thus be reduced as changes occur in the ambient medium so that the corresponding change in volume of said cells is limited.

As for the above-mentioned thick-walled separating membrane, having a $\rho \cdot C$ value closely approximating that of the ambient liquid, this can consist, when the ambient liquid is water, of a polymethylmethacrylate such as that commercially available under the trade name Plexiglas or, better still, of a polycarbonate such as the one known under the trade name Macrolon. Certain polyethylenes, or a neoprene already known as a protection for hydrophones, may also be used.

The damping fluid mentioned above can consist of water with a cellulose hydroxylether additive obtained by treating cellulose with sodium hydroxyle and reacting it with ethylene oxide. The product of this reaction is purified and supplied as a fine white powder. It is sold under the name Natrosol, by the French company Hercules France S.A., Tour Albert 1er, 92507 Rueil Malmaison Cedex, France.

The fourth alternative embodiment of the invention, illustrated in FIG. 7, appears particularly suitable for straight, rectangular supporting walls. The lining in this case consists of a juxtaposition of open-faced rectangular boxes 30 with their backs applied to the supporting wall 1. The additional or conduit walls can be purchased in the form of a honeycomb panel 5 sandwiched between two very thin, flexible sheets 5*a* and 5*b*. Sheet 5*a* is glued to a foam rubber backing 31 in the back of the box which forms the resilient compression volumes. Sheet 5*b* is slightly recessed in relation to the outside edges of the sides of the box. A rigid plate 32 of polymethylmethacrylate is glued to these outside edges to form the separating membrane, which is thus offset from the honeycomb 5 by a space 32*a*.

It should be understood that the various parts described and illustrated herein and in the drawings could be replaced by other parts serving the same technical functions, without departing from the scope and spirit of the invention as outlined in the following claims.

What is claimed is:

1. A sound absorbing wall lining having an inside surface adapted to be applied to a rigid supporting wall and an outside surface adapted to be steeped in a fluid environment, especially a liquid, traversed by acoustic waves, said lining comprising additional walls extending in a perpendicular direction from the supporting wall and forming therebetween a number of energy dissipating conduits in which an attenuating or dissipating fluid can move in a slight reciprocating motion normal to the supporting wall with a certain amount of friction, said conduits being substantially straight, with constant cross sections, and with openings at said outside surface and said inside surface, said lining further comprising a separating layer covering the outside openings of said conduits, which is permeable to acoustic waves, said lining wherein said energy dissipating conduits are filled with a dissipating fluid having a higher kinematic viscosity than the ambient fluid so that it may absorb, by laminar friction, the energy of said reciprocation motions, said separating layer being a membrane closing off the openings of the conduits to prevent the dissipating fluid from becoming diluted in the ambient fluid, said membrane being permeable to acoustic waves, and resilient, closed compression volumes being placed at the back of said conduits, in contact with the dissipating fluid, said volumes containing fluid more readily compressible than the ambient and the dissipating fluids such as to amplify said reciprocating motions of the latter fluid in response to incident acoustic waves.

2. A lining according to claim 1, wherein an equivalent hydraulic diameter d and length l of the energy dissipating conduits, a perforation rate S2/S1 of the lining at a level of said conduits and a density $\rho_1$ of the dissipating fluid are such as to substantially satisfy the equation:

$$32(\rho_1 \cdot v_1 \cdot / d^2)1 = \rho_o \cdot C_o(S2/S1)$$

where $\rho_o$ and $C_o$ stand respectively for the density of the ambient fluid and the velocity of acoustic waves in said fluid, such that there is a tuning frequency ($f_o$) for which matched frequency acoustic waves are virtually completely absorbed.

3. A lining according to claim 2, tuned to absorb waves at a frequency of less than about 1000 or 2000 Hz, said lining wherein the kinematic viscosity $v_1$ of said dissipating fluid is great enough and the equivalent hydraulic diameter d is small enough for the ratio of $v_1$ to $d^2$ to be more than 2,500 rd/s, such that the range of frequencies effectively absorbed will be broadly extended on each side of said tuning frequency $f_o$.

4. Lining according to claim 2 intended to absorb more particularly acoustic waves near a tuning frequency $f_o$, wherein the kinematic viscosity $v_1$ of said dissipating fluid is greater than, or at least only slightly less than the product $f_o \cdot d^2$ of said frequency times the square of the equivalent diameter d, so that the distribution of reciprocation speeds in the flow section of the dissipating conduit is comparable to that obtaining in a continuous, one-way laminar flow.

5. Lining according to claim 4, wherein said viscosity $v_1$ is greater than half said product $f_o \cdot d^2$.

6. Lining according to claim 4, wherein a stiffness K of said resilient compression volumes confronting said dissipating fluid is selected to be substantially $$K = 50/f_o^2 \cdot S2/\rho_1 \cdot 1$$

such that said tuning frequency is equal to frequency $f_o$, said stiffness K being the relation of a force to a motion, said force being a longitudinal force able to be applied to the back of a conduit by an acoustic wave, said motion being the longitudinal motion caused by said force and equal to the change in total volume of said compression volumes due to the action of said force, said change being divided by the cross section of the conduit.

7. Lining according to claim 1, applicable to a situation where the ambient fluid is a liquid, wherein said separating membrane is made of a material having a value of a product of $\rho_2 \cdot C_2$ equal to a product of $\rho_o \cdot C_o$ value of the ambient fluid, said product being that of the material's density times the material's sound velocity, to ensure sufficient thickness for the membrane for it to withstand external agressions and hydrostatic pressure differentials.

8. Lining according to claim 6, applicable to a situation where the ambient fluid is a liquid, wherein said dissipating fluid is an auxiliary liquid and said more readily compressible fluid is a gas enclosed in flexible cells, the overall enclosed volume of said flexible cell or cells at the back of each dissipating conduit being selected to yield approximately said K-value of stiffness.

9. Lining according to claim 8, wherein said dissipating fluid is made up of water with long-chain organic molecules added to enhance its viscosity.

10. Lining according to claim 8, wherein said gas is enclosed in said flexible cells at a swelling pressure greater than atmospheric pressure to prevent undue volume shrinkage of said cells when the surrounding hydraulic pressure increases.

11. Lining according to claim 1, wherein said dissipating conduits have an equivalent hydraulic diameter of less than 10 mm and more than 1 mm.

* * * * *